US008256932B2

(12) United States Patent
Chang

(10) Patent No.: US 8,256,932 B2
(45) **Date of Patent: *Sep. 4, 2012**

(54) LIGHT DIFFUSION PLATE AND BACKLIGHT MODULE USING THE SAME

(75) Inventor: Shao-Han Chang, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 279 days.

This patent is subject to a terminal disclaimer.

(21) Appl. No.: 12/205,933

(22) Filed: Sep. 8, 2008

(65) Prior Publication Data

US 2009/0323326 A1 Dec. 31, 2009

(30) Foreign Application Priority Data

Jun. 30, 2008 (CN) ..... 2008 1 0302454

(51) Int. Cl.
*F21V 5/02* (2006.01)

(52) U.S. Cl. ..... 362/339; 362/330; 362/618; 362/97.2

(58) Field of Classification Search ..... 362/606, 362/330–333, 338–340, 558, 607, 628, 97.2, 362/97.3, 223–225, 246, 309, 561, 612–621, 362/625–627; 359/530, 599, 615, 619, 625, 359/707, 831, 836, 837; 349/57, 62, 64, 349/65

See application file for complete search history.

(56) References Cited

U.S. PATENT DOCUMENTS

| | | | | |
|---|---|---|---|---|
| 3,764,800 | A * | 10/1973 | Clostermann | 362/330 |
| 7,320,538 | B2 * | 1/2008 | Ko et al. | 362/606 |
| 7,645,058 | B2 * | 1/2010 | Kurokawa et al. | 362/339 |
| 7,686,474 | B2 * | 3/2010 | Chou et al. | 362/237 |
| 2004/0090765 | A1 * | 5/2004 | Yu et al. | 362/31 |
| 2006/0256577 | A1 * | 11/2006 | Parker et al. | 362/606 |
| 2006/0256582 | A1 * | 11/2006 | Chuang | 362/620 |
| 2007/0171651 | A1 * | 7/2007 | Park et al. | 362/330 |
| 2008/0130117 | A1 * | 6/2008 | Hsu et al. | 359/599 |

FOREIGN PATENT DOCUMENTS

WO WO2005/083475 * 9/2005

* cited by examiner

*Primary Examiner* — Hargobind S Sawhney
(74) *Attorney, Agent, or Firm* — Altis Law Group, Inc.

(57) ABSTRACT

An exemplary light diffusion plate includes a main body, and a plurality of diffusion particles dispersed in the main body. The main body includes a first surface and a second surface. The first surface and the second surface are on opposite sides of the main body. The first surface is a flat surface. The second surface defines a plurality of rectangular structures. Each rectangular structure defines four adjacent triangular pyramid depressions. A backlight module using the light diffusion plate is also provided.

18 Claims, 6 Drawing Sheets

LIGHT DIFFUSION PLATE AND BACKLIGHT MODULE USING THE SAME

CROSS-REFERENCE TO RELATED APPLICATIONS

This application is related to five co-pending U.S. patent applications, which are: applications Ser. No. 12/319007, 12/319046, 12/319042, 12/317990, and 12/319006, and all entitled "OPTICAL PLATE AND BACKLIGHT MODULE USING THE SAME". In the co-pending applications, the inventor is Shao-Han Chang. The co-pending applications have the same assignee as the present application. The disclosure of the above identified applications is incorporated herein by reference.

BACKGROUND OF THE DISCLOSURE

1. Field of the Invention

The present disclosure relates to an optical plate, and particularly to a light diffusion plate employed in a direct type backlight module.

2. Description of the Related Art

Referring to FIG. 6, one such direct type backlight module 100 includes a frame 11, a plurality of point light sources 12, a light diffusion plate 13, and a prism sheet 10. The point light sources 12 are regularly arranged on a base of the frame 11. The light diffusion plate 13 and the prism sheet 10 are disposed on the point light sources 12 above a top of the frame 11 in that order. The light diffusion plate 13 includes a plurality of diffusion particles (not shown) configured for diffusing light. The prism sheet 10 includes a transparent substrate 101 and a prism layer 103 formed on a surface of the transparent substrate 101. The prism layer 103 forms a plurality of elongated V-shaped ridges 105.

In use, light from the point light sources 12 enters the diffusion plate 13 and becomes scattered. The scattered light leaves the diffusion plate 13 to the prism sheet 10. The scattered light then travels through the prism sheet 10 and is refracted out at the elongated V-shaped ridges 105 of the prism sheet 10. The refracted light leaving the prism sheet 10 is concentrated at the prism layer 103 and increases the brightness (illumination) of the prism sheet 10. The refracted light then propagates into a liquid crystal display panel (not shown) disposed above the prism sheet 10.

However, although light from point the light sources 12 enters the diffusion plate 13 and becomes scattered, after the light leaves the prism sheet 10, strong light spots of the point light sources 12 often occurs.

In order to reduce or eliminate the strong light spots of the point light sources 12, the backlight module 100 should further include an upper light diffusion film 14 disposed on the prism sheet 10. However, although the upper light diffusion film 14 and the prism sheet 10 are in contact with each other, a plurality of air pockets may still exist around the boundaries of the light diffusion film 14, the prism sheet 10, and the light diffusion plate 13. When the backlight module 100 is in use, light passes through the air pockets, and some of the light undergoes total reflection by the air pockets along one or another of the corresponding boundaries. In addition, the upper light diffusion film 14 may absorb a certain amount of the light from the prism sheet 10. As a result, a brightness of light illumination of the backlight module 100 is reduced.

Additionally, the direct type backlight module 100 is often manufactured in various sections and thus, have to be integrated together. The integration of the various sections of the direct type backlight module 100 often reduces the rigidity and mechanical strength of the direct type backlight module 100. The reduced rigidity and mechanical strength may result in reduced reliability of the direct type backlight module 100.

Therefore, a new light diffusion plate is desired in order to overcome the above-described shortcomings.

SUMMARY

A light diffusion plate includes a main body, and a plurality of diffusion particles dispersed in the main body. The main body includes a first surface and a second surface. The second surface is opposite to the first surface of the main body. The first surface has a flat surface. The second surface defines a plurality of rectangular structures. Each rectangular structure defines four adjacent triangular pyramid depressions.

A backlight module includes a frame, a plurality of point light sources, and a light diffusion plate. The point light sources are regularly arranged on a base of the frame. The light diffusion plate is disposed on the point light sources above a top of the frame. The light diffusion plate is the same plate described in a previous paragraph.

Other advantages and novel features will become more apparent from the following detailed description of various embodiments, when taken in conjunction with the accompanying drawings.

BRIEF DESCRIPTION OF THE DRAWINGS

The components in the drawings are not necessarily drawn to scale, the emphasis instead being placed upon clearly illustrating the principles of the present light diffusion plate. Moreover, in the drawings, like reference numerals designate corresponding parts throughout several views, and all the views are schematic.

DETAILED DESCRIPTION

Reference will now be made to the drawings to describe various inventive embodiments of the present light diffusion plate in detail.

Figure 1:
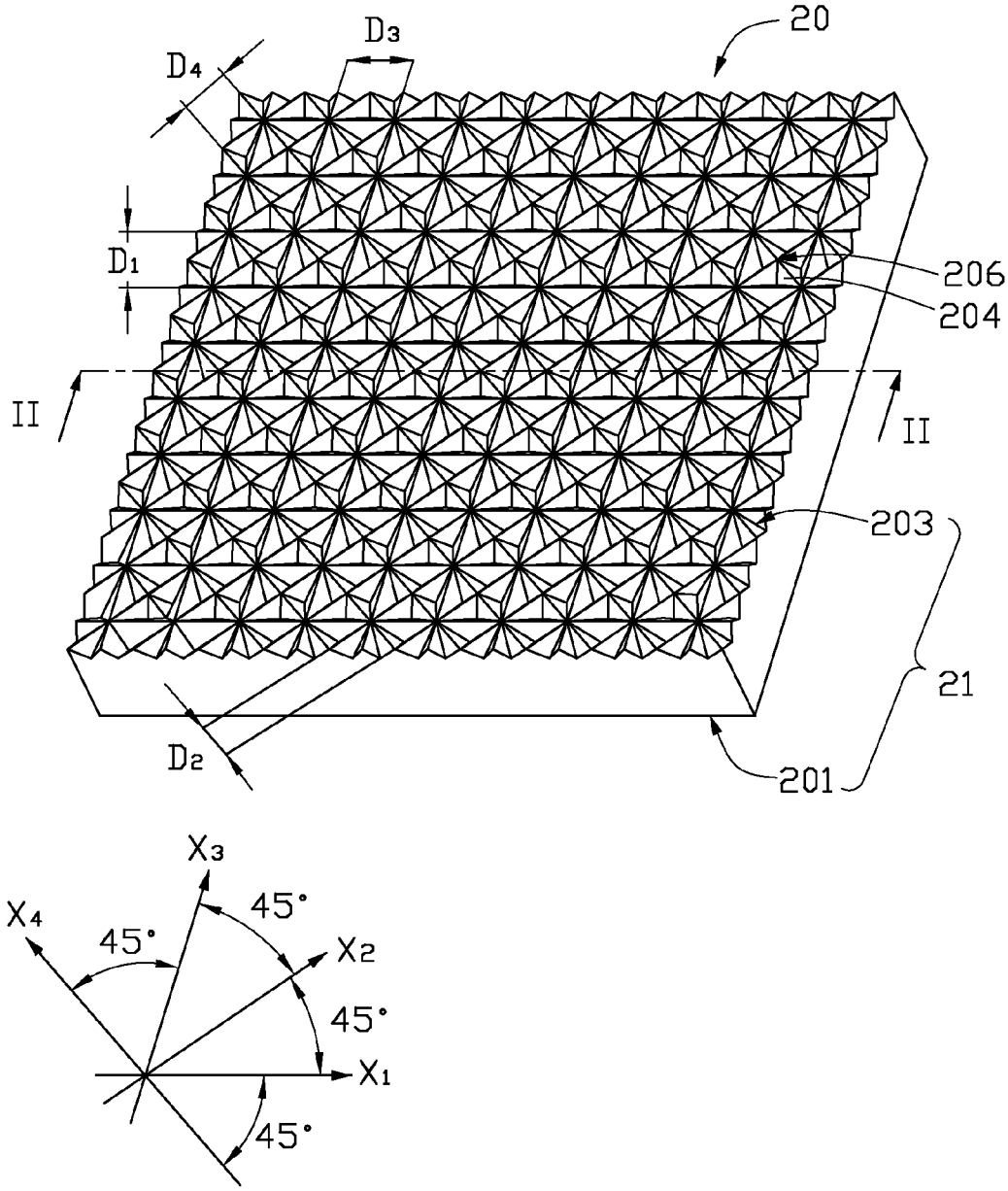
FIG. 1 is an isometric view of a light diffusion plate in accordance with a first embodiment of the present disclosure.
Figure 2:
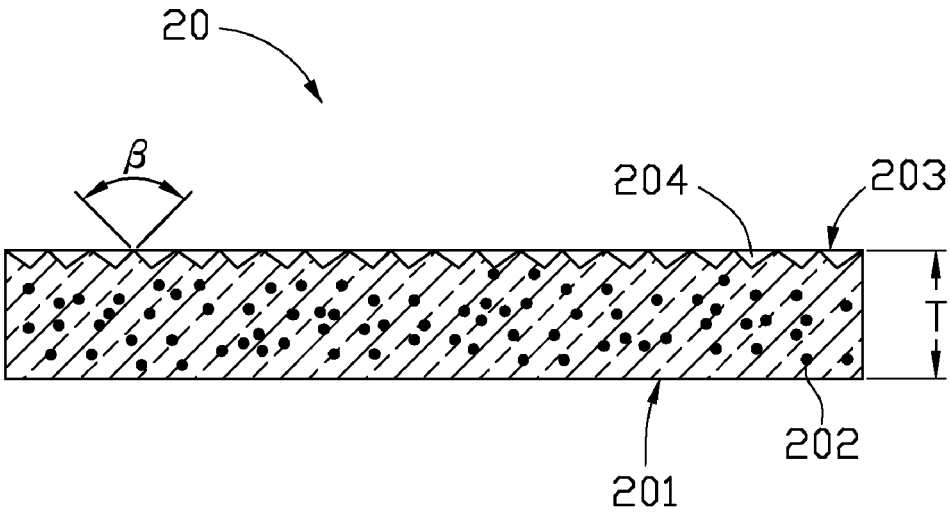
FIG. 2 is a side cross-sectional view taken along the line II-II of FIG. 1.

Referring to FIGS. 1 and 2, a light diffusion plate 20, of a first embodiment of the present disclosure, includes a main body 21. The main body 21 includes a first surface 201 and a second surface 203. The first surface 201 and the second surface 203 are on opposite sides of the main body 21. The first surface 201 is a flat surface. The second surface 203 defines a plurality of rectangular structures 206 and each rectangular structure 206 defines four adjacent triangular pyramid depressions 204. Each side of the rectangular structure 206 is bordered with a side of another adjacent rectangular structure 206.

The triangular pyramid depressions 204 are closely connected. In each rectangular structure 206, the four triangular pyramid depressions 204 together with the sidewalls thereof cooperatively form a four-pointed star. The four-pointed stars are distributed in a matrix manner in the second surface 203.

In the illustrated embodiment, corresponding sidewalls on each side of adjacent pyramid depressions 204 sharing a same edge collectively form V-shaped ridges, namely, a plurality of first V-shaped ridges, a plurality of second V-shaped ridge, a plurality of third V-shaped ridges, and a plurality of fourth V-shaped ridges. The first V-shaped ridges extend along a first direction $X_1$. The second V-shaped ridges extend along a second direction $X_2$. The third V-shaped ridges extend along a third direction $X_3$. The fourth V-shaped ridges extend along a fourth direction $X_4$.

The first, second, third, and fourth V-shaped ridges intersect with one another and cooperatively define the triangular pyramid depressions 204. In addition, the first V-shaped ridges and the third V-shaped ridges intersect with each other and form a plurality of intersections. Each of the plurality of intersections also intersects the second V-shaped ridges and the fourth V-shaped ridges correspondingly.

The first direction $X_1$ and the second direction $X_2$ cooperatively define an angle $\theta_1$, the second direction $X_2$ and the third direction $X_3$ cooperatively define an angle $\theta_2$, the third direction $X_3$ and the fourth direction $X_4$ cooperatively define an angle $\theta_3$, and the first direction $X_1$ and the fourth direction $X_4$ cooperatively define an angle $\theta_4$. The angles $\theta_1$, $\theta_2$, $\theta_3$, $\theta_4$, are all about 45 degrees.

A vertex angle $\beta$ of the V-shaped ridge is in the range from about 80 degrees to about 100 degrees. A pitch of the adjacent first V-shaped ridges is in the range from about 0.025 millimeters to about 1 millimeter. In the illustrated embodiment, the relations of the first, the second, the third, and the fourth V-shaped ridges are determined by the formula: $D_1=D_3=\sqrt{2}\,D_2=\sqrt{2}\,D_4$, wherein $D_1$ represents a pitch between the adjacent first V-shaped ridges, $D_2$ represents a pitch between the adjacent second V-shaped ridges, $D_3$ represents a pitch between the third adjacent V-shaped ridges, and $D_4$ represents a pitch between the adjacent fourth V-shaped ridges.

Referring to FIG. 2 again, a thickness T of the light diffusion plate 20 is in the range from about 0.4 millimeters to about 4 millimeters. The light diffusion plate 20 includes a matrix resin (not labeled) and a plurality of diffusion particles 202 dispersed in the matrix resin. The matrix resin is selected from the group consisting of polycarbonate, polymethyl methacrylate, polystyrene, copolymer of methyl methacrylate and styrene, and any suitable combination of those. The diffusion particles 202 are selected from the group consisting of silicon dioxide particles, titanium dioxide particles, acrylate copolymer particles and any combination of those. The light diffusion plate 20 preferably has a light transmission ratio in the range from larger than 80% to less than 100%. A mold used to manufacture the light diffusion plate 20 includes a plurality of triangular pyramid protrusions formed on a second side surface. The triangular pyramid protrusions are configured to form the triangular pyramid depressions 204 on the second surface 203 of the light diffusion plate 20, such that the light diffusion plate 20 can be produced at a same time per injection molding.

Figure 3:
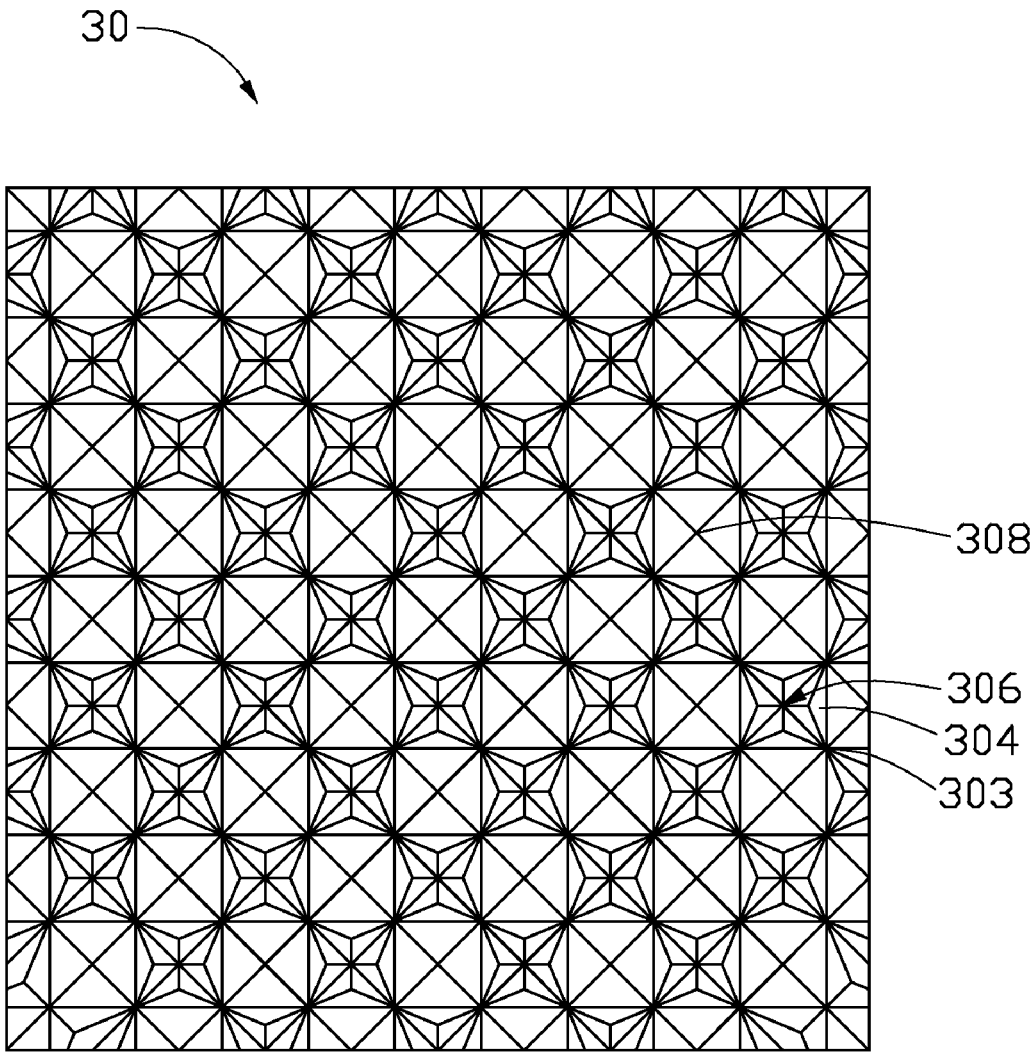
FIG. 3 is a top plan view of a light diffusion plate in accordance with a second embodiment of the present disclosure.

Referring to FIG. 3, a light diffusion plate 30 in accordance with a second embodiment of the present disclosure is shown. The light diffusion plate 30 is similar in principle to the light diffusion plate 20 of the first embodiment of the present disclosure, but the second surface 303 defines a plurality of rectangular structures 306 and a plurality of quadrilateral pyramid depressions 308. Each rectangular structure 306 defines four adjacent triangular pyramid depressions 304. The four adjacent triangular pyramid depressions 304 of each rectangular structure 306 are closely connected and together with sidewalls thereof cooperatively form a four-point star having eight triangular side surfaces. Each side of the rectangular structures 306 borders one side of one quadrilateral pyramid depression 308. In other words, each rectangular structure 306 is surrounded by four quadrilateral pyramid depressions 308, and each quadrilateral pyramid depression 308 is surrounded by four rectangular structures 306.

Figure 4:
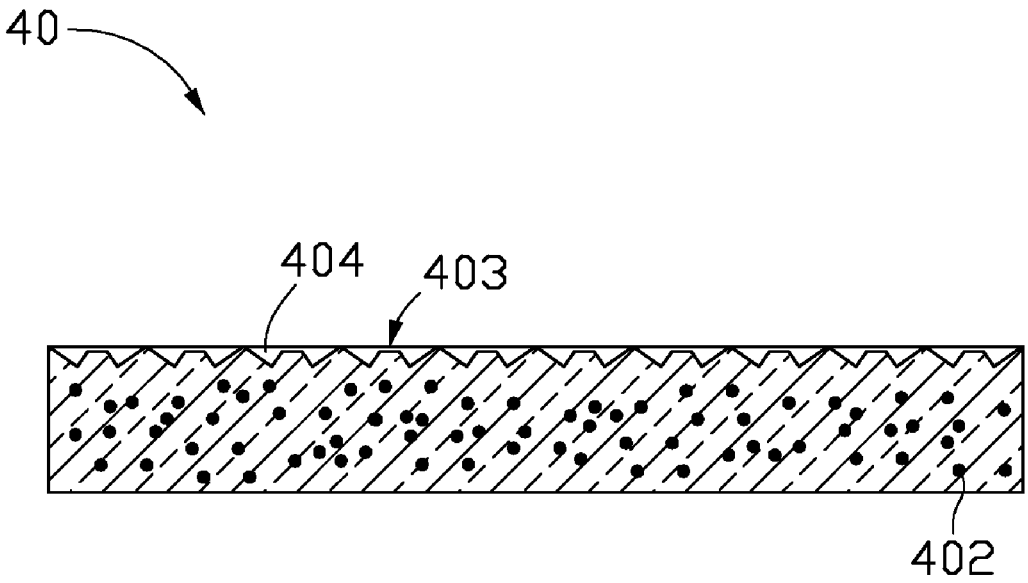
FIG. 4 is a side cross-sectional view of a light diffusion plate in accordance with a third embodiment of the present disclosure.

Referring to FIG. 4, a light diffusion plate 40 in accordance with a third embodiment of the present disclosure is shown. The light diffusion plate 40 is similar in principle to the light diffusion plate 20 of the first embodiment, but has a plurality of the triangular pyramid depressions 404 that are defined in the second surface 403. However, a top end of the V-shaped ridges is flat. Because the top end of the V-shaped ridges is flat, mechanical strength of the V-shaped ridges is enhanced. As a result, the light diffusion plate 40 has a higher reliability than a light diffusion plate with the V-shaped ridges having a top that becomes easily damaged when used.

Figure 5:
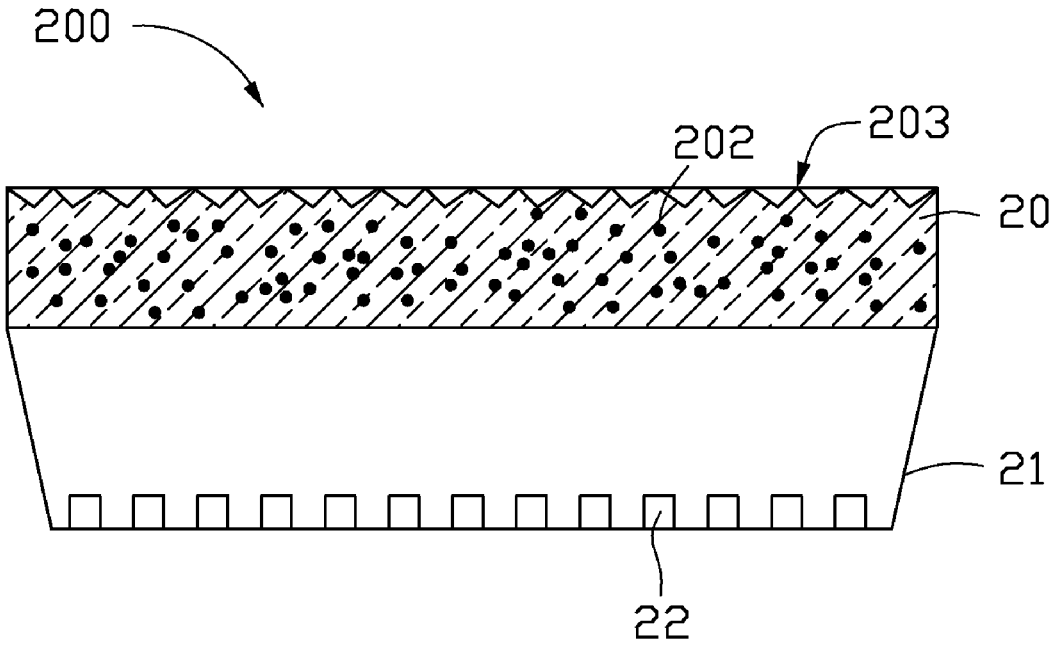
FIG. 5 is a side cross-sectional view of a backlight module in accordance with a fourth embodiment of the present disclosure.
Figure 6:
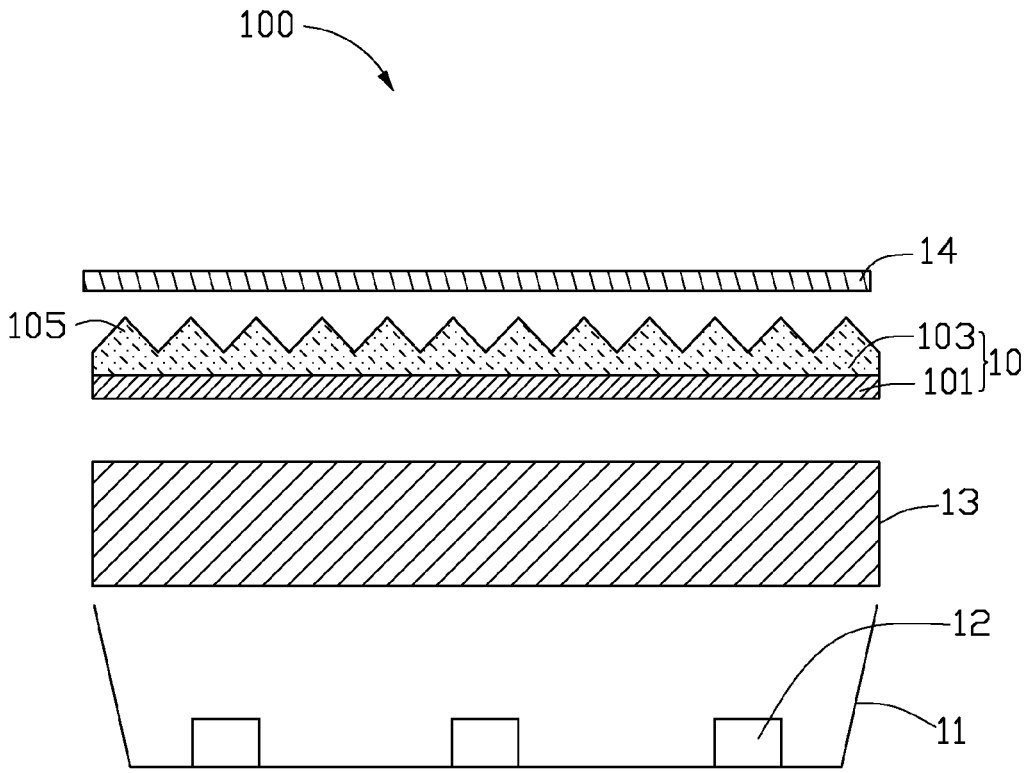
FIG. 6 (RELATED ART)
FIG. 6 is a side cross-sectional view of a backlight module.

Referring to FIG. 5, a backlight module 200 in accordance with a fourth embodiment of the present disclosure is shown. The backlight module 200 includes a frame 21, a plurality of point light sources 22, and a light diffusion plate 20. The point light sources 22 are regularly arranged on a base of the frame 21. The light diffusion plate 20 is disposed on the point light sources 22 above a top of the frame 21. The light diffusion plate 20 is described above. The first surface 201 of the light diffusion plate 20 is facing the point light sources 22 and the second surface 203 of the light diffusion plate 20 is farther away from the point light sources 22. Light enters the light diffusion plate 20 via the first surface 201.

In the illustrated embodiment of FIG. 3, light emitted from the light diffusion plate 20 of the backlight module 200 forms a plurality of smaller light spots according to each of the point light sources 22. Thus, a relatively uniform surface light source is achieved. Therefore, when the light diffusion plate 20 is employed in a backlight module, strong light spots of the light sources seldom occurs, more uniform light is achieved, and there is no need to add an upper light diffusion film between the light diffusion plate 20 and the liquid crystal display panel. Thus, the efficiency of light utilization is enhanced.

In addition, because the triangular pyramid depressions 204 form the first, the second, the third, and the fourth V-shaped ridges, light emitted from the second surface 203 concentrates in planes perpendicular to the first direction $X_1$, the second direction $X_2$, the third direction $X_3$, and the fourth direction $X_4$ respectively, thereby increasing the brightness (illumination) of the light diffusion plate 20 along a direction perpendicular to the second surface 203. Thus, there is no need to add a prism sheet between the light diffusion plate 20 and the liquid crystal display panel.

Furthermore, the light diffusion plate 20 is integrally formed by injection molding technology. The injection molding process causes the light diffusion plate 20 to have a stronger rigidity and mechanical strength because the light diffusion plate is formed as a whole unit integrally. Thus the light diffusion plate 20 has a relatively high reliability.

Finally, while various inventive embodiments has been described and illustrated, the present disclosure is not to be construed as being limited thereto. Various modifications can be made to the embodiments by those of ordinary skill in the art without departing from the true spirit and scope of the disclosure as defined by the appended claims.

What is claimed is:

1. A light diffusion plate comprising:

a main body, and a plurality of diffusion particles dispersed in the main body, the main body comprising:

a first surface, the first surface having a flat surface; and a second surface opposite to the first surface of the main body, the second surface defining a plurality of rectangular structures and a plurality of quadrilateral pyramid depressions, each rectangular structure defining four adjacent triangular pyramid depressions, each side of the rectangular structures borders one side of one quadrilateral pyramid depression;

wherein each rectangular structure takes up a substantially same area projected on the second surface as each quadrilateral pyramid depression, each triangular pyramid depression of the rectangular structure comprises three triangular surfaces; each quadrilateral pyramid depression comprises four triangular surfaces; the four triangular pyramid depressions of each rectangular structure are closely connected and together with sidewalls thereof cooperatively form a four-pointed star having sixteen edges; each rectangular structure is surrounded by four quadrilateral pyramid depressions, and each quadrilateral pyramid depression is surrounded by four rectangular structures;

wherein corners of each of the plurality of the rectangular structures borders with four other of the plurality of the rectangular structures at the corners; sidewalls on each side of adjacent triangular pyramid depressions share a same edge, the same edges of the four triangular pyramid depressions of each rectangular structure collectively form vertices of a first V-shaped ridge aligned in a first direction, a second V-shaped ridge aligned in a second direction, a third V-shaped ridge aligned in a third direction, and a fourth V-shaped ridge aligned in a fourth direction, and each triangular pyramidal depression is defined by three of the four V-shaped ridges aligned in four different directions; each side of the rectangular structure is about the same length and that each side of the rectangular structure is about the same length as a side of the quadrilateral pyramid depression.

2. The light diffusion plate as claimed in claim 1, wherein for each rectangular structure the first V-shaped ridges and the third V-shaped ridges intersect with each other to form an intersection intersecting the second V-shaped ridge and the fourth V-shaped ridge.

3. The light diffusion plate as claimed in claim 2, wherein an angle defined by the first direction and the second direction, an angle defined by the second direction and the third direction, an angle defined by the third direction and the fourth direction, and an angle defined by the fourth direction and the first direction are about 45 degrees.

4. The light diffusion plate as claimed in claim 2, wherein a vertex angle of each of the V-shaped ridges is in the range from about 80 degrees to about 100 degrees.

5. The light diffusion plate as claimed in claim 2, wherein at least one portion of the top end of the V-shaped ridge is flat.

6. The light diffusion plate as claimed in claim 1, wherein the thickness of the light diffusion plate is in the range from about 0.4 millimeters to about 4 millimeters.

7. The light diffusion plate as claimed in claim 1, wherein the main body is made of a matrix resin selected from the group consisting of polycarbonate, polymethyl methacrylate, polystyrene, and copolymer of methyl methacrylate and styrene.

8. The light diffusion plate as claimed in claim 1, wherein the diffusion particles are selected from the group consisting of silicon dioxide particles, titanium dioxide particles, and acrylate copolymer particles.

9. A backlight module comprising:

a frame, a plurality of point light sources arranged on a base of the frame, and a light diffusion plate disposed on the point light source at a top of the frame, wherein the light diffusion plate comprises a main body, and a plurality of diffusion particles dispersed in the main body, the main body comprising: a first surface, the first surface having a flat surface; and a second surface opposite to the first surface of the main body, the second surface defining a plurality of rectangular structures and a plurality of quadrilateral pyramid depressions, each rectangular structure defining four adjacent triangular pyramid depressions, each side of the rectangular structures borders one side of one quadrilateral pyramid depression;

wherein each rectangular structure takes up a substantially same area projected on the second surface as each quadrilateral pyramid depression, each triangular pyramid depression of the rectangular structure comprises three triangular surfaces; each quadrilateral pyramid depression comprises four triangular surfaces; the four triangular pyramid depressions of each rectangular structure are closely connected and together with sidewalls thereof cooperatively form a four-pointed star having sixteen edges; each rectangular structure is surrounded by four quadrilateral pyramid depressions, and each quadrilateral pyramid depression is surrounded by four rectangular structures;

wherein corners of each of the plurality of the rectangular structures borders with four other of the plurality of the rectangular structures at the corners; sidewalls on each side of adjacent triangular pyramid depressions share a same edge, the same edges of the four triangular pyramid depressions of each rectangular structure collectively form vertices of a first V-shaped ridge aligned in a first direction, a second V-shaped ridge aligned in a second direction, a third V-shaped ridge aligned in a third direction, and a fourth V-shaped ridge aligned in a fourth direction, and each triangular pyramidal depression is defined by three of the four V-shaped ridges aligned in four different directions; each side of the rectangular structure is about the same length and that each side of the rectangular structure is about the same length as a side of the quadrilateral pyramid depression.

10. The backlight module as claimed in claim 9, wherein for each rectangular structure the first V-shaped ridges and the third V-shaped ridges intersect with each other to form an intersection intersecting the second V-shaped ridge and the fourth V-shaped ridge.

11. The backlight module as claimed in claim 10, wherein an angle defined by the first direction and the second direction, an angle defined by the second direction and the third direction, an angle defined by the third direction and the fourth direction, and an angle defined by the fourth direction and the first direction are about 45 degrees.

12. The backlight module as claimed in claim 10, wherein a vertex angle of each of the V-shaped ridges is in the range from about 80 degrees to about 100 degrees.

13. The backlight module as claimed in claim 10, wherein at least one portion of the top end of the V-shaped ridge is flat.

14. The backlight module as claimed in claim 9, wherein the thickness of the light diffusion plate is in the range from about 0.4 millimeters to about 4 millimeters.

15. The backlight module as claimed in claim 9, wherein the main body is made of a matrix resin selected from the group consisting of polycarbonate, polymethyl methacrylate, polystyrene, and copolymer of methyl methacrylate and styrene.

16. The backlight module as claimed in claim 9, wherein the diffusion particles are selected from the group consisting of silicon dioxide particles, titanium dioxide particles, and acrylate copolymer particles.

17. A light diffusion plate comprising:

a main body, and a plurality of diffusion particles dispersed in the main body, the main body comprising:

a first surface, the first surface having a flat surface; and a second surface opposite to the first surface of the main body, the second surface defining a plurality of rectangular structures and a plurality of quadrilateral pyramid depressions, each rectangular structure defining four adjacent triangular pyramid depressions, each side of the rectangular structures borders one side of one quadrilateral pyramid depression;

wherein each rectangular structure takes up a substantially same area projected on the second surface as each quadrilateral pyramid depression, each triangular pyramid depression of the rectangular structure comprises three triangular surfaces; each quadrilateral pyramid depression comprises four triangular surfaces; the four triangular pyramid depressions of each rectangular structure are closely connected and together with sidewalls thereof cooperatively form a four-pointed star having sixteen edges; each rectangular structure is surrounded by four quadrilateral pyramid depressions, and each quadrilateral pyramid depression is surrounded by four rectangular structures.

18. The backlight module as claimed in claim 17, wherein corners of each of the plurality of the rectangular structures borders with four other of the plurality of the rectangular structures at the corners, each side of the rectangular structure is about the same length and that each side of the rectangular structure is about the same length as a side of the quadrilateral pyramid depression.

* * * * *